US010184712B2

(12) United States Patent
Park et al.

(10) Patent No.: US 10,184,712 B2
(45) Date of Patent: Jan. 22, 2019

(54) FAN-MOTOR ASSEMBLY AND REFRIGERATOR HAVING THE SAME

(71) Applicant: LG ELECTRONICS INC., Seoul (KR)

(72) Inventors: Hongseok Park, Seoul (KR); Myungkwang Song, Seoul (KR); Gyeonghwan Kweon, Seoul (KR)

(73) Assignee: LG Electronics Inc., Seoul (KR)

( * ) Notice: Subject to any disclaimer, the term of this patent is extended or adjusted under 35 U.S.C. 154(b) by 319 days.

(21) Appl. No.: 14/943,364

(22) Filed: Nov. 17, 2015

(65) Prior Publication Data

US 2016/0138598 A1 May 19, 2016

(30) Foreign Application Priority Data

Nov. 18, 2014 (KR) ..... 10-2014-0161039

(51) Int. Cl.

| | |
|---|---|
| ***F04D 17/16*** | (2006.01) |
| ***F04D 25/06*** | (2006.01) |
| ***F04D 25/08*** | (2006.01) |
| ***F25D 17/06*** | (2006.01) |

(52) U.S. Cl.

CPC ..... *F25D 17/067* (2013.01); *F04D 17/16* (2013.01); *F04D 25/062* (2013.01); *F04D 25/064* (2013.01); *F04D 25/08* (2013.01); *F25D 2317/0681* (2013.01)

(58) Field of Classification Search

CPC ..... F04D 17/16; F04D 25/062; F04D 25/064; F04D 13/06; F04D 25/06; F04D 25/0606; F04D 25/0613; F04D 25/08; F25D 17/067; F25D 2317/0681

See application file for complete search history.

(56) References Cited

U.S. PATENT DOCUMENTS

| | | | | |
|---|---|---|---|---|
| 6,170,275 | B1 * | 1/2001 | Ueno | F04D 29/541 416/174 |
| 2008/0302120 | A1 * | 12/2008 | Kang | F24F 1/0014 62/259.1 |
| 2009/0113921 | A1 * | 5/2009 | Bae | F25D 17/067 62/441 |
| 2009/0185919 | A1 * | 7/2009 | Yoo | F04D 25/0613 417/354 |

FOREIGN PATENT DOCUMENTS

| | | | |
|---|---|---|---|
| JP | 2006-180643 | 7/2006 | |
| KR | 10-2010-0027899 | 3/2010 | |
| KR | 1020080086998 A1 * | 3/2010 | H02K 21/22 |

OTHER PUBLICATIONS

Office Action issued in Korean Application No. 10-2014-0161039 dated Dec. 24, 2015, 6 pages.

* cited by examiner

*Primary Examiner* — Philip Stimpert
(74) *Attorney, Agent, or Firm* — Fish & Richardson P.C.

(57) ABSTRACT

A fan-motor assembly includes a fan which includes a hub and blades and generates a wind by using a rotational force, and an outer rotor fan motor which includes a stator and a rotor rotating at the periphery of the stator and is coupled to the fan by a shaft to provide the rotational force to the fan. In the fan-motor assembly, the rotor includes a magnet generating magnetic flux for rotating the rotor, and a rotor frame which surrounds the magnet to be coupled to the outer circumferential surface of the magnet and is spaced apart from the hub by the shaft so as not to be directly contacted with the hub.

16 Claims, 6 Drawing Sheets

FAN-MOTOR ASSEMBLY AND REFRIGERATOR HAVING THE SAME

CROSS-REFERENCE TO RELATED APPLICATIONS

Pursuant to 35 U.S.C. § 119(a), this application claims the benefit of earlier filing date and right of priority to Korean Application No. 10-2014-0161039, filed on Nov. 18, 2014, the contents of which are incorporated by reference herein in its entirety.

BACKGROUND OF THE DISCLOSURE

1. Field of the Disclosure

The present disclosure relates to a fan-motor assembly generating a wind and a refrigerator having the same.

2. Description of the Conventional Art

A refrigerator is a device for keeping food frozen/cooled therein, and includes a refrigerator main body having cooling compartments formed therein and a refrigeration cycle device for maintaining a cooled state in the cooling compartments. In general, a machine room is formed in a rear area of the refrigerator main body, and a compressor and a condenser in the refrigeration cycle device are installed in the machine room.

A cool air flow path is formed inside the refrigerator main body such that air in the cooling compartments can be cooled while flowing, and an evaporator is provided on the cool air flow path to cool air. A fan-motor assembly is provided inside the machine room and at one side of the evaporator to accelerate the flow of air.

The fan-motor assembly includes a fan and a motor, and is a device which generates a wind as the fan is rotated by a rotational force provided from the motor. The fan-motor assembly is used in various technical fields which require wind. For example, the fan-motor assembly may be used in an air conditioner, and the like, as well as the above-described refrigerator.

Since the fan-motor assembly is a device in which some of components rotate, friction between the components may be generated in a rotating process of the fan-motor assembly. If a sufficient balance between the components is not maintained, vibration and noise may be generated.

The friction lowers the mechanical integrity of the fan-motor assembly and the device having the same, and the vibration and noise cause inconvenience in the use of the fan-motor assembly and degradation of the operating performance of the fan-motor assembly. Thus, the friction between the components is reduced, and the sufficient balance between the components is maintained, thereby improving the performance of the fan-motor assembly.

As the capacity of the refrigerator increases, the flow rate of wind required in the fan-motor assembly continuously increases, and hence the rotational frequency of the fan increases. Therefore, it is more likely that vibration and noise will be generated in the fan-motor assembly. Particularly, as customers' requirements of noise reduction increase, it has recently been required to develop a low-vibration, low-noise fan-motor assembly.

SUMMARY OF THE DISCLOSURE

Therefore, an aspect of the detailed description is to provide a fan-motor assembly having a structure capable of preventing the generation of vibration transmitted from a motor to a fan.

Another aspect of the detailed description is to provide a fan-motor assembly capable of minimizing deformation to be generated in a process of coupling components to each other.

Still another aspect of the detailed description is to provide a fan-motor assembly and a refrigerator having the same, which can realize low vibration and low noise even in high-speed rotation.

To achieve these and other advantages and in accordance with the purpose of this specification, as embodied and broadly described herein, a fan-motor to assembly includes: a fan including a hub and blades, the fan generating a wind by using a rotational force; and an outer rotor fan motor including a stator and a rotor rotating at the periphery of the stator, the outer rotor fan motor being coupled to the fan by a shaft to provide the rotational force to the fan, wherein the rotor includes: a magnet generating magnetic flux for rotating the rotor; and a rotor frame surrounding the magnet to be coupled to the outer circumferential surface of the magnet, the rotor frame being spaced apart from the hub by the shaft so as not to be directly contacted with the hub.

In one exemplary embodiment, the rotor frame may be integrally formed with the shaft.

In one exemplary embodiment, the shaft may protrude from the rotor frame to be inserted into the hub.

In one exemplary embodiment, the outer circumferential surface of the rotor frame may be spaced apart from the inner circumferential surface of the hub.

In one exemplary embodiment, at least one portion of the rotor frame may be formed in a dome shape to accommodate the stator therein.

In one exemplary embodiment, a stepped portion may be formed along the circumference of the rotor frame on the outer circumferential surface of the rotor frame to restrict vibration transmitted to the shaft.

In one exemplary embodiment, the rotor frame may include a first portion coupled to the shaft, the first portion extending in the circumferential direction from the shaft; a second portion extending in a direction parallel to the shaft from the first portion; the stepped portion extending in the circumferential direction from the second portion; and a third portion extending in a direction parallel to the shaft from the stepped portion.

In one exemplary embodiment, the rotor frame may have a coupling portion to formed on the inner circumferential surface of the third portion to be coupled to the magnet.

In one exemplary embodiment, a holding projection may be formed between the inner circumferential surface of the second portion and the inner circumferential surface of the third portion to fix the position of the magnet coupled to the coupling portion.

In one exemplary embodiment, the rotor frame may have a protruding portion formed to protrude toward the hub around the shaft. The hub may have a recessed portion formed at a portion opposite to the protruding portion so as not to be directly contacted with the first portion.

In one exemplary embodiment, the rotor frame may have a supporting portion formed at a portion opposite to the stator. The supporting portion may radially protrude around the shaft.

In one exemplary embodiment, the fan may have a shaft accommodating portion protruding from the hub. At least one portion of the shaft accommodating portion may be divided into two branches to surround the shaft at both sides thereof.

In one exemplary embodiment, the fan-motor assembly may further include a spring coupled to the outer circumferential surface of the shaft accommodating portion to fix the fan and the shaft.

In one exemplary embodiment, the fan-motor assembly may further include a first bearing and a second bearing, respectively disposed at one side and the other side of the stator to fix the position of the stator; a PCB assembly electrically connected to the stator to apply electrical signals to the stator; and an insulator disposed between the rotor and the stator to electrically insulate the rotor and the stator from each other.

To achieve these and other advantages and in accordance with the purpose of this specification, as embodied and broadly described herein, a refrigerator includes the above-described fan-motor assembly.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWING

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF EXEMPLARY EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
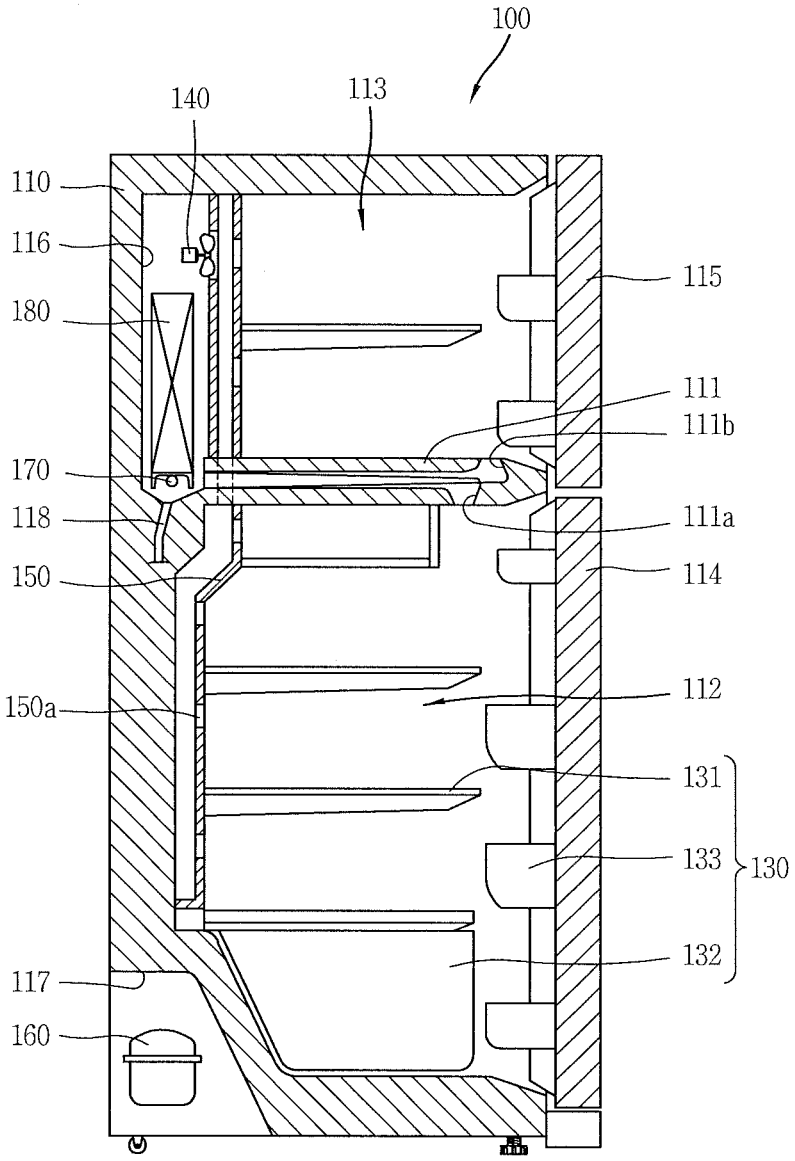
FIG. 1 is a conceptual view of a refrigerator according an exemplary embodiment.

FIG. 1 is a conceptual view of a refrigerator 100 according an exemplary embodiment.

The refrigerator 100 is a device for keeping food stored therein at low temperature by using a refrigeration cycle in which processes of compression, condensation, expansion and evaporation are consecutively performed.

As shown in this figure, a refrigerator main body 110 has a storage space for keeping food therein. The storage space may be partitioned by a partition wall 111, and divided into a refrigerator compartment 112 and a freezer compartment 113.

In this exemplary embodiment, there is shown a top mount type refrigerator in which the freezer compartment 113 is disposed above the refrigerator compartment 112, but the present disclosure is not limited thereto. The present disclosure may also be applied to a side-by-side type refrigerator in which a freezer compartment and a refrigerator compartment are disposed at the left and right sides of the refrigerator, a bottom freezer type refrigerator in which a freezer compartment is disposed under a refrigerator compartment, and the like.

Doors 114 and 115 are connected to the refrigerator main body 110, to open/close a front opening of the refrigerator main body 110. In this figure, a refrigerator compartment door 114 and a freezer compartment door 115 are configured to open/close front portions of the refrigerator compartment 112 and the freezer compartment 113, respectively. The doors 114 and 115 may be variously configured as rotary type doors connected to the refrigerator main body 110 to be rotatably movable, drawer type doors connected to the refrigerator main body 110 to be slidingly movable, etc.

At least one receiving unit 130 (e.g., including shelves 131, trays 132, baskets 133, etc.) for efficient use of the storage space inside the refrigerator main body 110 is provided in the refrigerator main body 110. For example, the shelves 131 and the trays 132 may be installed inside the refrigerator main body 110, and the baskets 133 may be installed inside the doors 114 and 115 connected to the refrigerator main body 110.

Meanwhile, a cooling compartment 116 is provided at a rear side of the freezer compartment 113. An evaporator 180 is provided in the cooling compartment 116, and a fan-motor assembly 140 is provided above the evaporator 180. A refrigerator compartment return duct 111*a* and a freezer compartment return duct 111*b*, which enable air in the refrigerator compartment 112 and the freezer compartment 113 to be sucked and returned into the cooling compartment 116, are formed in the partition wall 111. Also, a cool air duct 150 which communicates with the freezer compartment 11 and has a plurality of cool air discharge holes 150*a* is installed at a rear side of the refrigerator compartment 112.

A machine room 117 is provided at a rear lower side of the refrigerator main body 110, and a compressor 160, a condenser (not shown), and the like are provided inside the machine room 170.

Air in the refrigerator compartment 112 and the freezer compartment 113 is sucked into the cooling compartment 116 through the refrigerator compartment return duct 111*a* and the freezer compartment return duct 111*b*2 in the partition wall 111 to be heat-exchanged with the evaporator 180. Then, the heat-exchanged air is again discharged to the refrigerator compartment 112 and the freezer compartment 113 through the cool air discharge holes 150*a* of the cool air duct 150. The above-described process is repeatedly performed.

Frost may be formed on a surface of the evaporator 180 due to a temperature difference with circulation air again flowed into the evaporator 180 through the refrigerator compartment return duct 111*a* and the freezer compartment return duct 111*b*. In order to remove the frost, a defrosting device 170 is provided to the evaporator 180.

Hereinafter, a fan-motor assembly will be described.

Figure 2A:
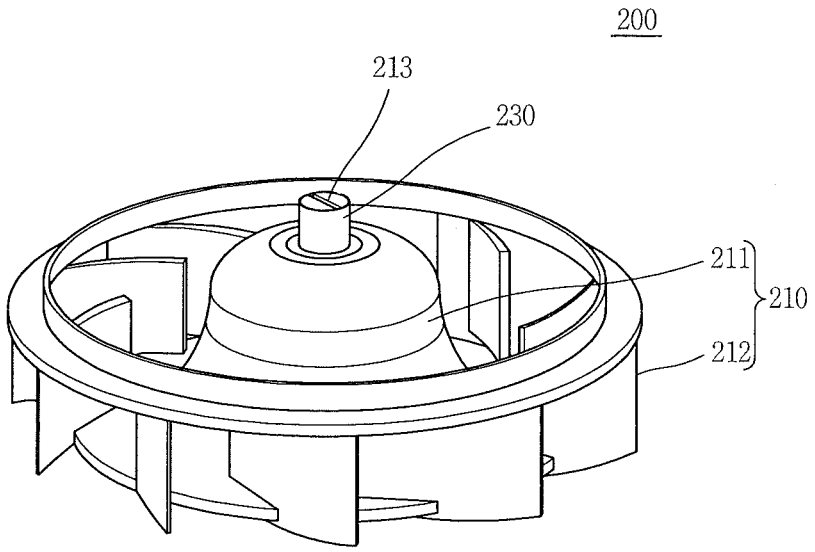
FIGS. 2A and 2B are perspective views showing an example of a fan-motor assembly applied to FIG. 1.
Figure 2B:
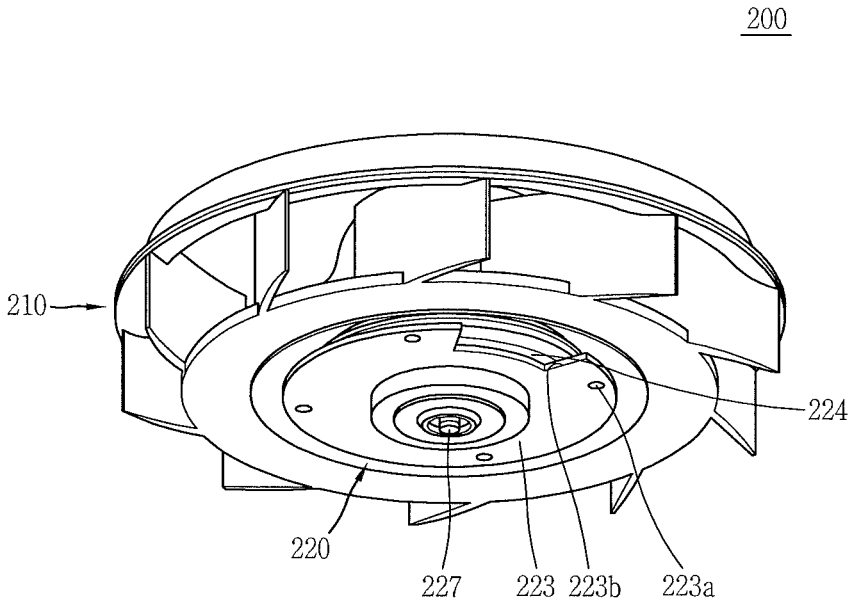

FIGS. 2A and 2B are perspective views showing an example of a fan-motor assembly 200 applied to FIG. 1.

The fan-motor assembly 200 includes a fan 210 and an outer rotor fan motor 220.

The fan 210 includes a hub 211 and blades 212, and is formed to generate a wind by using a rotational force.

The hub 211 is formed to accommodate a stator 221 (see FIGS. 3 and 4) and a rotor 226 (see FIGS. 3 and 4) therein.

The stator 221 and the rotor 226 are components which generate a rotational force through an electromagnetic interaction. Structures and functions of the stator 221 and the rotor 226 will be described later with reference to FIGS. 3 and 4. The hub 211 may be formed in a dome shape having at least one open portion. The hub 211 may be formed in a shape where the size of its internal diameter increases from its top to its bottom based on FIG. 2A.

The blades 212 are coupled to the hub 211, and may be integrally formed with the hub 211. The blades 212 are arranged in a sloped radial shape to generate a wind. As shown in these figures, the blade 212 may be formed in the shape of a plate. The blade 212 is provided in plurality, and rotates to generate a wind.

The material constituting the fan 210 may be selected in consideration of its moldability. For example, ABS resin may be selected as the material of the fan 210, but the present disclosure is not necessarily limited thereto.

A spring 230 is coupled to a handle portion of the hub 211. The spring 230 is formed to surround a shaft accommodating portion 213, and used to fix a shaft 227.

Most components constituting the fan-motor assembly 200 are accommodated in the fan 210, and hence the external appearance of the fan-motor assembly 200 is substantially is formed by the fan 210 and a lower bearing 223. A detailed configuration of the outer rotor fan motor 220 will be described later with reference to other drawings.

Figure 3:
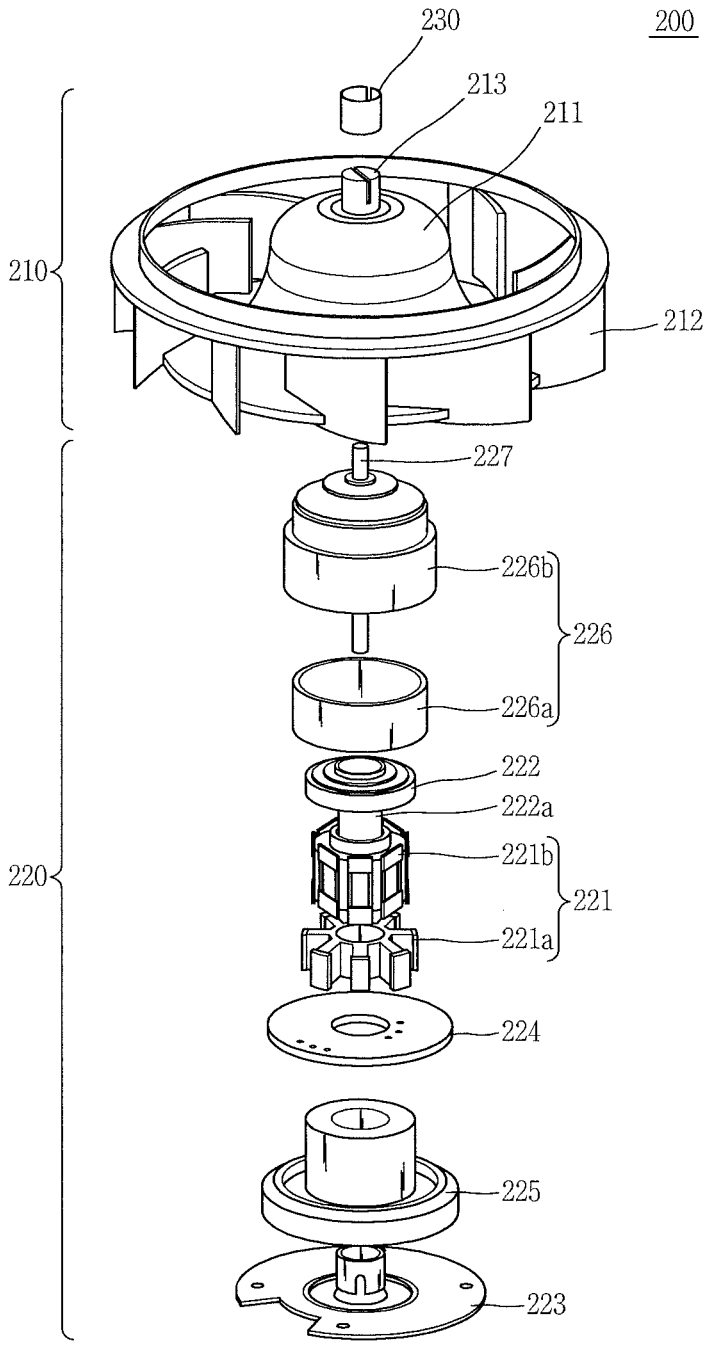
FIG. 3 is an exploded perspective view of the fan-motor assembly.
Figure 4:
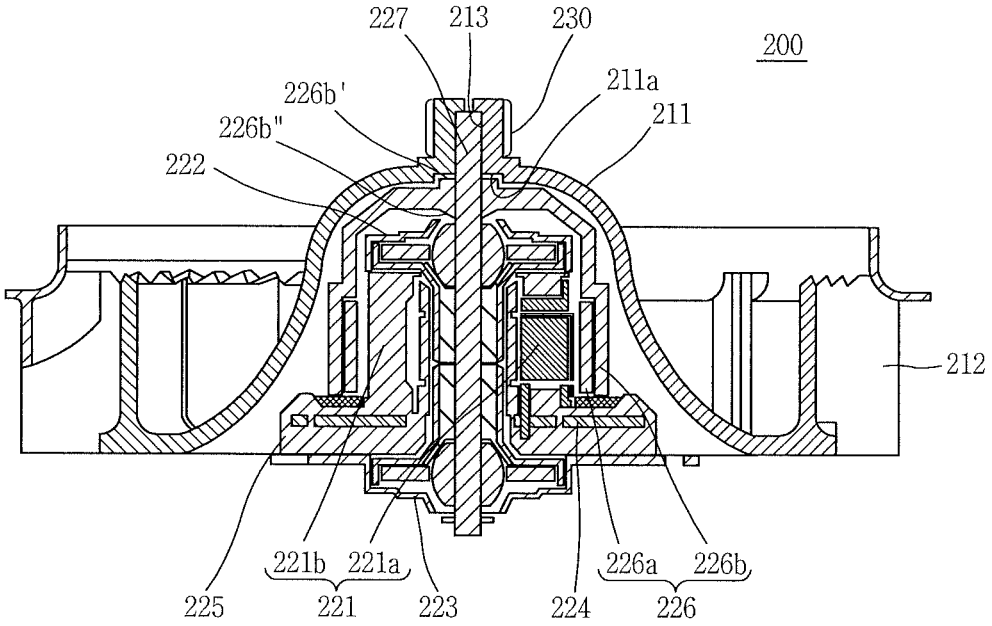
FIG. 4 is a sectional view of the fan-motor assembly.

The lower bearing 223 may be referred to as a second bearing 223 so as to be distinguished from an upper bearing (or first bearing) 222 (see FIGS. 3 and 4). Here, the concept "upper/lower" may be changed depending on a reference position. Hereinafter, the fan-motor assembly 200 will be described by using the terms "first bearing 222" and "second bearing 223" instead of the terms "upper bearing 222" and "lower bearing 223."

Coupling holes 223*a* and a slot 223*b*2 may be formed in the second bearing 223.

The coupling holes 223*a* are used such that the fan-motor assembly 200 is coupled to a mount (not shown). If a screw coupled to the mount is inserted into the coupling hole 223*a*, the fan-motor assembly 200 can be fixed to the mount.

The slot 223*b*2 is used to connect a PCB assembly 224 or coil (not shown) to an external power line or control line. The external power line and control line may be connected to the PCB assembly 224 or coil.

Hereinafter, an internal structure of the fan-motor assembly 200 will be described.

FIG. 3 is an exploded perspective view of the fan-motor assembly 200. FIG. 4 is a sectional view of the fan-motor assembly 200.

As described above, the fan-motor assembly 200 includes the fan 210 and the outer rotor fan motor 220. The fan 210 has been described above, and therefore, its description will be omitted. Hereinafter, the outer rotor fan motor 220 will be mainly described.

A fan motor means a motor for driving a fan, and may be generally referred to as a motor. The outer rotor fan motor 220 has a structure in which the stator 221 is disposed at a central portion of the shaft 227 and the rotor 226 rotates at the periphery of the stator 221.

The outer rotor fan motor 220 is coupled to the fan 210 by the shaft 227. More specifically, the outer rotor fan motor 220 is coupled to the hub 211 by the shaft 227. The outer rotor fan motor 220 provides a rotational force to the fan 210 through the shaft 227. The outer rotor fan motor 220 includes the stator 221 and the rotor 226. The rotor 226 is configured to rotate at the periphery of the stator 221, and the stator 221 and the rotor 226 generate a rotational force through an electromagnetic interaction.

Referring to FIG. 3, the stator 221 includes a core 221*a*, an insulator 221*b*, and a coil (not shown).

The core 221*a* generates magnetic flux of the stator 221 for creating a rotating magnetic field. The core 221*a* has teeth portions stretched in a radial shape to wind the coil.

The insulator 221*b*2 is formed of an insulating material so as to maintain electrical insulation of the coil from the core 221*a*. The insulator 221*b*2 may be formed with two components to be respectively coupled to upper and lower portions of the core 221*a*. If the core 221*a* and the insulator 221*b*2 are coupled to each other, end portions of the teeth portions are exposed to the edge of the insulator 221*b*2. The core 221*a* and the insulator 221*b*2 may be integrally formed by insert injection molding.

The coil (not shown) is wound around the insulator 221*b*2. Specifically, the core 221*a* has the teeth portions, the insulator 221*b*2 is coupled to the teeth portions, and the coil is wound around the insulator 221*b*2 surrounding the teeth portions. Thus, the electrical insulation between the core 221*a* and the coil is made by the insulator 221*b*2. Also, the position at which the coil is wound may be determined by the insulator 221*b*2.

The first bearing 222 and the second bearing 223 are disposed at both sides of the stator 221. The first bearing 222 and the second bearing 223 are configured to fix the positions of components constituting the stator 221 at both the sides of the stator 221. In order to fix the components, the first bearing 222 may have a first bracket and the second bearing 223 may have a second bracket. An intermediate bracket 222*a* inserted into a hollow portion of the stator 221 may be connected to the first bearing 222. The stator 221 is disposed between the first bearing 222 and the second bearing 223.

The PCB assembly 224 is electrically connected to the stator 221 to apply electrical signals to the stator 221. The PCB assembly 224 may be substantially formed in the shape of a disk. The PCB assembly 224 is disposed at a lower portion of the stator 221. The fan-motor assembly 200 can be driven by a voltage applied through the PCB assembly 224.

The rotor 226 is configured to rotate through an electromagnetic interaction with the stator 221. While the stator 221 is fixed, the rotor 226 rotates at the periphery of the stator 221.

The rotor 226 includes a magnet 226*a* and a rotor frame 226*b*.

The magnet 226*a* generates magnetic flux for rotating the rotor 226. The magnet 226*a* may be formed in an annular shape to surround the stator 22 while being spaced apart from the stator 221 at an air gap.

In a conventional art, there was a motor in which a structure corresponding to a magnet is formed in a hub, and the magnet is directly coupled to the hub. In the motor, a fan was formed by injection molding. In this case, the hub was deformed by contraction after the injection molding, and therefore, did not maintain a sufficient balance with the magnet. Accordingly, vibration was generated due to a density difference of magnetic flux, and transmitted from the magnet to the fan along the integrated structure in which the fan and magnet were directly coupled to each other, thereby resulting in noise in a fan-motor assembly.

In order to solve this problem in the conventional art, the present disclosure is provided for the purpose of maintaining a sufficient balance between the fan 210 and magnet 226*a*. The magnet 226*a* is not directly coupled to the hub 211.

Instead, in the present disclosure, the rotor frame **226*b*2 is disposed between the hub 211 and the magnet 226*a*, to allow the hub 211 and the magnet 226*a*** to be spaced apart from each other.

The rotor frame **226*b*2 is formed such that at least one portion of the rotor frame 226*b*2 surrounds the magnet 226*a*. For example, the rotor frame 226*b*2 may be formed in a dome shape to surround the magnet 226*a*, and the magnet 226*a* may be coupled to the inner circumferential surface of the rotor frame 226*b*. Here, the dome shape defined as the shape of the rotor frame 226*b*2 is not necessarily limited to the meaning of the term "hollow hemisphere," but indicates a structure including all structures each formed to have at least one open portion and accommodate the stator 221 therein. Therefore, whether at least one portion of the rotor frame 226*b* is formed in a flat or curved surface shape, and the like do not become references for determining whether the rotor frame 226*b* is formed in the dome shape, but correspond to the dome-shaped structure of the rotor frame 226*b***.

The rotor frame **226*b* is spaced apart from the hub 211 by the shaft 227 so as not to be directly contacted with the hub 211. The spacing structure between the rotor frame 226*b* and the hub 211 can be more clearly identified with reference to FIG. 4. The shaft 227 connects the rotor frame 226*b* and the hub 211 to each other, but the rotor frame 226*b* is not directly contacted with the hub 211. In addition to a handle portion of the rotor frame 226*b*, the outer circumferential surface of the rotor frame 226*b* is also spaced apart from the inner circumferential surface of the hub 211**.

As the rotor frame **226*b* is not directly contacted with the hub 221 but coupled to the hub 211 by the shaft 227, it is possible to solve problems issued in the conventional art. Specifically, the magnet 226*a* of the present disclosure is not directly coupled to the hub 211, and thus it is possible to block the transmission route of vibration generated by an imbalance between components. Also, in the present disclosure, it is possible to minimize deformation of components, caused as the magnet is directly coupled to the hub in the conventional art, and accordingly, it is possible to reduce noise generated in the fan-motor assembly 200**.

The rotor frame **226*b* and the shaft 227 may be integrally formed. The integrated structure of the rotor frame 226*b* and the shaft 227 may be formed by, for example, an insert injection molding method. If resin as the original material of the rotor frame 226*b* is injection-molded in a state in which the shaft 227 is inserted, the rotor frame 226*b* and the shaft 227** with the integrated structure can be manufactured.

The resin as the original material of the rotor frame **226*b* may be selected in consideration of tensile strength and vibratility. In relation to the tensile strength, the magnet 226*a* is inserted into the rotor frame 226*b*, and therefore, the tolerance and linear expansion coefficient of the resin are to be considered. Particularly, the linear expansion coefficients of the magnet 226*a* and the rotor frame 226*b* are to be overlapped such that there occurs no crack. In relation to the vibratility, the resin is to have durability against vibration generated when the fan-motor assembly 200** rotates.

The shaft 227 passes through at least one portion of the rotor frame **226*b*. The shaft 227 may substantially pass through a central portion of the rotor frame 226*b*. The central portion of the rotor frame 226*b* corresponds to the handle portion of the rotor frame 226*b*. Referring to FIG. 4, the shaft 227 may protrude from the rotor frame 226*b* to be inserted into the hub 211**.

The shaft 227 connects the rotor frame **226*b* and the fan 210. The rotational force generated through the electromagnetic interaction between the stator 221 and the rotor 226 is transmitted to the fan 210 by the shaft 227**.

In a conventional art, there was a motor having a structure in which a rotor frame, a rotor, and a shaft were fixed by fixing the rotor frame and the rotor, formed with a zinc plating steel sheet, and pressing one end portion of the shaft into the rotor frame of the rotor. Particularly, in the conventional art, the rotor frame was inserted into a fan made of synthetic resin, and a melting material was injected and molded, thereby implementing a coupling structure.

However, the coupling between the fan and the rotor frame through the pressing damages the external appearance of the shaft, and the inclination of the center of gravity to one side after the coupling occurs due to the weight of the fan and the rotor frame. Also, as the coupling structure is implemented through melting, an imbalance of the rotor occurs, which results in the generation of vibration and noise.

On the other hand, in the present disclosure, the rotor frame **226*b* is formed of the resin, and the rotor frame 226*b* and the shaft 227 are integrally formed, so that it is possible to solve the problems of the damage due to the pressing and the inclination of the center of gravity. Also, in the present disclosure, instead of the coupling through melting, the shaft 227 is inserted into the shaft accommodating portion 213, and fixed by the spring 230, so that it is possible to solve the problem of vibration and noise, caused by the imbalance of the rotor 226. The configuration in which the shaft 227 is inserted into the shaft accommodating portion 213 and fixed by the spring 230** will be described as follows.

Referring to FIG. 4, the fan 210 has the shaft accommodating portion 213 protruding from the hub 211. The shaft accommodating portion 213 may substantially protrude from a central portion of the hub 211. The shaft 227 is inserted into the shaft accommodating portion 213 to be coupled to the fan 210. At least one portion of the shaft accommodating portion 213 is divided into two branches to surround the shaft 227 at both sides thereof. Since the shaft accommodating portion 213 is divided into two branches, a portion of the shaft accommodating portion 213 is widened when the shaft 227 is inserted into the shaft accommodating portion 213. However, the shaft accommodating portion 213 pressurize the shaft 22 at both the sides thereof, and thus the shaft 227 can be inserted and coupled into the shaft accommodating portion 213 even though the shaft 227 is not pressed.

Referring to FIG. 3, the spring 230 is coupled to the outer circumferential surface of the shaft accommodating portion 213 to fix the fan 210 and the shaft 227. The spring 230 is formed to surround the shaft accommodating portion 213. The spring 230 pressurizes the outer circumferential surface of the shaft accommodating portion 213. Accordingly, it is possible to prevent the shaft 227 from being arbitrarily separated from the shaft accommodating portion 213.

The rotor frame **226*b* has a protruding portion 226*b*' formed to protrude toward the hub 211 around the shaft 227. Corresponding to the protruding portion 226*b*', the hub 211 has a recessed portion 211*a* formed at a portion opposite to the protruding portion 226*b*' so as not to be directly contacted with a first portion 226*b*1 (see FIG. 5A). The protruding portion 226*b*' is provided for the purpose of reinforcing the rigidity of a portion surrounding the shaft 227** and simultaneously avoiding the generation of resonance.

In addition, the rotor frame **226*b* has a supporting portion 226*b*" formed at a portion opposite to the stator 221. The supporting portion 226*b*" is provided for the purpose of reinforcing the rigidity of a portion surrounding the shaft 227** and simultaneously avoiding the generation of resonance.

Since each component has a unique oscillation frequency, components having unique oscillation frequencies overlapped in the rotation of the fan-motor assembly 200 generate resonance. The resonance becomes a cause that increases the amplitude of the overlapped oscillation frequency, thereby increasingly generating noise. The protruding portion 226*b*' and the supporting portion 226*b*" are configured to change the unique oscillation frequency of the rotor frame 226*b*, thereby avoiding the generation of resonance.

An insulator 225 is disposed between the rotor 226 and the stator 221 to electrically insulate the rotor 226 and the stator 221 from each other. The first bearing 222, the stator 221, and the PCB assembly 224 are inserted into the insulator 225, and the second bearing 223 is coupled to a lower portion of the insulator 225. In addition, the rotor 226 is coupled to the outside of the insulator 225. The stator 221 and the rotor 226 are spatially separated from each other by the insulator 225, so that electrical insulation can be made between the stator 221 and the rotor 226.

Hereinafter, a detailed structure of the rotor frame 226*b* will be described.

Figure 5A:
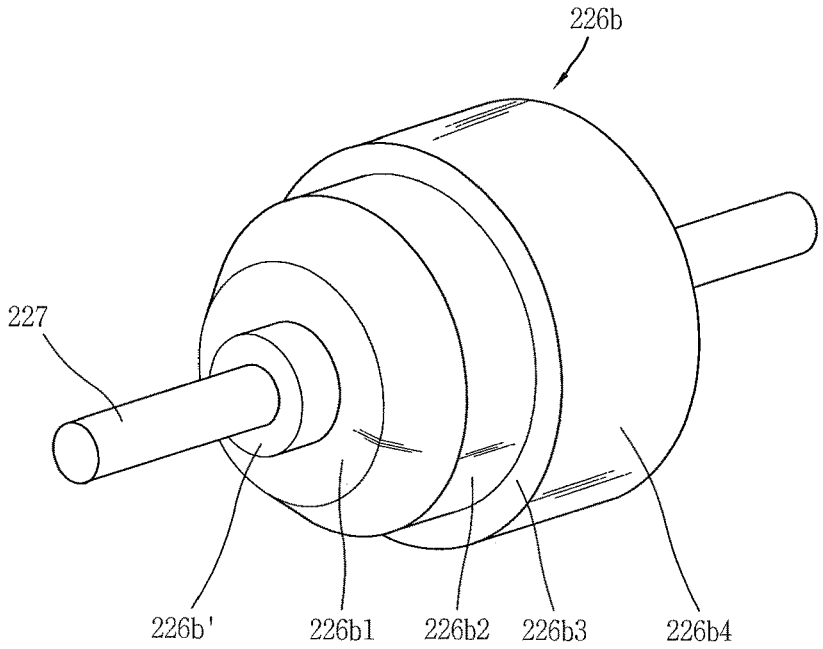
FIGS. 5A and 5B are perspective views showing a rotor frame viewed in different directions.
Figure 5B:
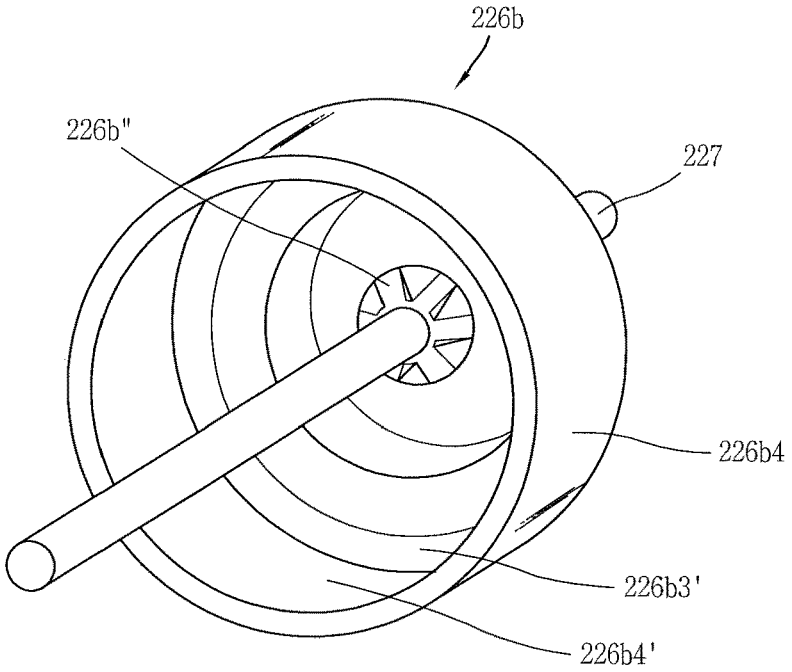

FIGS. 5A and 5B are perspective views showing the rotor frame 226*b* viewed in different directions.

The rotor frame 226*b* is formed to accommodate the stator 221 (see FIGS. 3 and 4) therein, and at least one portion of the rotor frame 226*b* may be formed in a dome shape. A stepped portion 226*b*3 may be formed along the circumference of the rotor frame 226*b* on the outer circumferential surface of the rotor frame 226*b* so as to restrict vibration transmitted to the shaft 227.

Dimensions of the stator 221 and the rotor 226 cannot perfectly correspond to each other in a mass production, and therefore, an imbalance between the stator 221 and the rotor 226 may occur due to the distribution of dimensions in the mass production. In addition, vibration may be generated due to the imbalance between the stator 221 and the rotor 226. If the vibration is transmitted to the shaft 227 along the rotor frame 226*b*, the vibration is transmitted up to the fan 210 through the shaft 227, which results in the generation of noise.

However, if the stepped portion 226*b*3 is formed on the outer circumferential surface of the rotor frame 226*b*, there is an effect of blocking the transmission mechanism of the vibration transmitted to the shaft 227. Thus, the stepped portion 226*b*3 blocks the path of the vibration transmitted to the shaft 227 from the rotor frame 226*b*, thereby limiting the transmission of the vibration.

The rotor frame 226*b*2 includes the first portion 226*b*1, a second portion 226*b*2, the stepped portion 226*b*3, and a third portion 226*b*4.

The first portion 226*b*1 is coupled to the shaft 227, and extends in the circumferential direction from the shaft 227. Referring to FIG. 5A, one portion of the first portion 226*b*1 may extends in the circumferential direction, and another portion of the first portion 226*b*1 may extends in a direction inclined with respect to the shaft 227. The first portion 226*b*1 refers to an area formed between the shaft 227 and the second portion 226*b*2, and at least one portion of the first portion 226*b*1 may be formed in a curved surface shape so as to form a dome shape.

The protruding portion 226*b*2' may protrude from the first portion 226*b*1. The protruding portion 226*b*2' is formed at a circumference of the shaft 227, to reinforce the rigidity of the rotor frame 226*b*. The supporting portion 226*b*2" is formed at a portion corresponding to the protruding portion 226*b*2'. In this case, the protruding portion 226*b*2' and the supporting portion 226*b*2" are formed in areas opposite to each other. The supporting portion 226*b*2" may radially protrude around the shaft 227. The supporting portion 226*b*2" also reinforces the rigidity of the rotor frame 226*b*2 supporting the shaft 227. As described above, the generation of resonance can be avoided by the protruding portion 226*b*2' and the supporting portion 226*b*2". Therefore, its description will be omitted.

The second portion 226*b*2 extends in a direction parallel to the shaft 227. The second portion 226*b*2 may substantially extend in the direction parallel to the shaft 227. However, the present disclosure is not necessarily limited thereto, and the second portion 226*b*2 may extend in a direction inclined with respect to the shaft 227.

The stepped portion 226*b*3 is formed between the second portion 226*b*2 and the third portion 226*b*4, and extends in the circumferential direction.

The third portion 226*b*4 extends in a direction parallel to the shaft 227 from the stepped portion 226*b*3. Like the second portion 226*b*2, the third portion 226*b*4 may also extend in the direction parallel to the shaft 227, but the present disclosure is not necessarily limited thereto.

The rotor frame 226*b*2 has a coupling portion 226*b*4' formed on the inner circumferential surface of the third portion 226*b*4 to be coupled to the magnet 226*a*. The coupling portion 226*b*4' is formed to correspond to the outer circumferential surface of the magnet 226*a*. As the magnet 226*a* is inserted into the coupling portion 226*b*4', the magnet 226*a* and the rotor frame 226*b*2 can be coupled to each other.

A holding projection 226*b*3' is formed between the inner circumferential surface of the second portion 226*b*2 and the inner circumferential surface of the third portion 226*b*4 to fix the position of the magnet 226*a* coupled to the coupling portion 226*b*4'. The holding projection 226*b*3' may be substantially formed at a portion corresponding to the stepped portion 226*b*3, but the holding projection 226*b*3' and the stepped portion 226*b*3 are formed in areas opposite to each other. In other words, the holding projection 226*b*3' is formed on the inner circumferential surface of the rotor frame 226*b*, and the stepped portion 226*b*3 is formed on the outer circumferential surface of the rotor frame 226*b*.

A step difference may be formed on the inner circumferential surface of the rotor frame 226*b*2 by the holding projection 226*b*3'. However, if the magnet 226*a* is coupled to the coupling portion 226*b*4', the step difference is not exposed. Hereinafter, an anti-noise effect obtained by applying the present disclosure will be described.

Figure 6:
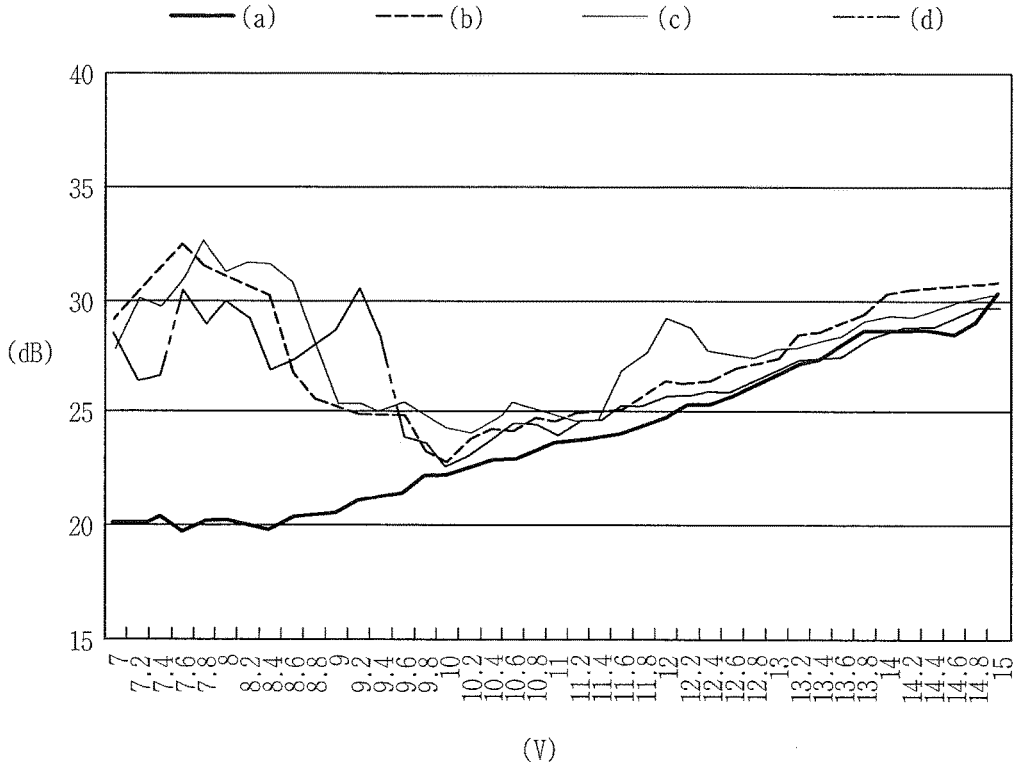
FIG. 6 is a graph proving an anti-noise effect.

FIG. 6 is a graph proving an anti-noise effect.

The horizontal axis of the graph represents voltages (V) applied to the fan-motor assembly, and the vertical axis of the graph represents noises (dB). As the voltage increases, the number of revolutions per minute (rpm) of the fan-motor assembly increases, and therefore, the fan-motor assembly rotates at a higher speed. As the value of the vertical axis increases, the noise increases.

In the graph, (a) shows noises of the fan-motor assembly to which the structure of the present disclosure is applied according to voltages. (b), (c), and (d) selected as comparison groups show noises of conventional fan-motor assemblies according to voltages. Each of the conventional fan-motor assemblies has a structure in which a fan and a magnet are directly coupled to each other.

In the graph of FIG. 6, it can be seen that the noise of (a) to which the structure of the present disclosure is applied is lower than those of (b), (c), and (d) in most areas. Particularly, it can be seen that the difference between noises is further significant.

Thus, it can be seen that the structure of the present disclosure, in which the magnet is coupled to the rotor frame, and the rotor frame is spaced apart from the fan by the shaft, has a sufficient anti-noise effect as compared with the structure in which the fan and the magnet are directly coupled to each other.

The above-described fan-motor assembly and the refrigerator having the same are not limited to the configurations and methods of the above-described exemplary embodiments, and all or some of the exemplary embodiments may be selectively combined to achieve various modifications.

According to the present disclosure configured as described above, the rotor frame and the fan are spaced apart from each other by the shaft, so that it is possible to prevent the generation of friction, vibration, and noise, which are caused by contact between rotor frame and the fan. Particularly, the magnet of the present disclosure is not directly coupled to the fan but coupled to the rotor frame, so that the balance between components is stably maintained as compared with the structure in which the magnet is directly coupled to the fan, thereby reducing the generation of noise.

Also, the present disclosure has a structure in which the rotor frame and the shaft are integrally formed, and the shaft is inserted into the fan. This structure can reduce the generation of deformation as compared with the structure in which the rotor frame and fan are coupled to each other, and the shaft is pressed into the rotor frame. In addition, the reduction in the generation of deformation can reduce the possibility that vibration and noise will be generated due to the deformation.

What is claimed is:

1. A fan-motor assembly comprising:

a fan including a hub and blades, the fan being configured to produce airflow using a rotational force; and a fan motor including a stator and a rotor configured to rotate at a periphery of the stator, the fan motor being coupled to the fan by a shaft to provide the rotational force to the fan, wherein the rotor includes:

a magnet configured to generate magnetic flux for rotating the rotor; and a rotor frame that surrounds the magnet and that is coupled to an outer circumferential surface of the magnet, the rotor frame being spaced apart from the hub by the shaft such that the rotor frame does not contact the hub, wherein the hub is configured to receive the fan motor and has an inner diameter that increases toward the fan motor along a direction parallel to the shaft, an inner surface of the hub being configured to face an outer surface of the rotor frame, wherein the rotor frame comprises:

a first portion coupled to the shaft, the first portion extending in a radial direction from the shaft and corresponding to an inner shape of the hub, a second portion extending from the first portion in the direction parallel to the shaft, a stepped portion extending from a circumference of the second portion in the radial direction to correspond to the inner shape of the hub, the stepped portion being configured to restrict vibration transmitted to the shaft, a third portion extending from the stepped portion in the direction parallel to the shaft, and a coupling portion that is located on an inner circumferential surface of the third portion and that is configured to be coupled to the magnet, wherein the rotor frame has a protruding portion that protrudes toward the hub around the shaft, and wherein the hub has a recessed portion opposite to the protruding portion such that the hub does not directly contact the first portion.

2. The fan-motor assembly of claim 1, wherein the rotor frame is integrally formed with the shaft.

3. The fan-motor assembly of claim 1, wherein the shaft protrudes from the rotor frame and is inserted into the hub.

4. The fan-motor assembly of claim 1, wherein the inner surface of the hub comprises an inner circumferential surface and the outer surface of the rotor frame comprises an outer circumferential surface, wherein the outer circumferential surface of the rotor frame is spaced apart from the inner circumferential surface of the hub.

5. The fan-motor assembly of claim 1, wherein at least a portion of the rotor frame has a dome shape that accommodates the stator within the dome shape of the rotor frame.

6. The fan-motor assembly of claim 1, wherein the rotor frame includes a holding projection located between an inner circumferential surface of the second portion and an inner circumferential surface of the third portion, the holding projection being configured to fix a position of the magnet coupled to the coupling portion.

7. The fan-motor assembly of claim 1, wherein the rotor frame has a supporting portion located opposite to the stator, wherein the supporting portion protrudes radially around the shaft.

8. The fan-motor assembly of claim 1, wherein the fan has a shaft accommodating portion protruding from the hub, and wherein at least a portion of the shaft accommodating portion is divided into two branches that surround the shaft at both sides of the shaft.

9. The fan-motor assembly of claim 8, further comprising a spring that is coupled to an outer circumferential surface of the shaft accommodating portion and that is configured to fix the fan and the shaft.

10. The fan-motor assembly of claim 1, further comprising:

a first bearing disposed at a first side of the stator;

a second bearing disposed at a second side of the stator that is opposite to the first side of the stator, the first and second bearings being configured to fix a position of the stator;

a printed circuit board (PCB) assembly that is electrically connected to the stator and that is configured to apply electrical signals to the stator; and an insulator that is disposed between the rotor and the stator and that is configured to electrically insulate the rotor and the stator from each other.

11. The fan-motor assembly of claim 1, wherein the hub has a dome shape having an inner diameter that increases toward the fan motor along the direction parallel to the shaft.

12. A refrigerator comprising:

a compartment;

a door configured to open and close at least a portion of the compartment; and a fan-motor assembly comprising:

a fan including a hub and blades, the fan being configured to produce airflow directed toward the compartment using a rotational force; and a fan motor including a stator and a rotor configured to rotate at a periphery of the stator, the fan motor being coupled to the fan by a shaft to provide the rotational force to the fan, wherein the rotor includes:

a magnet configured to generate magnetic flux for rotating the rotor; and a rotor frame that surrounds the magnet and that is coupled to an outer circumferential surface of the magnet, the rotor frame being spaced apart from the hub by the shaft such that the rotor frame does not contact the hub, wherein the hub is configured to receive the fan motor and has an inner diameter that increases toward the fan motor along a direction parallel to the shaft, an inner surface of the hub being configured to face an outer surface of the rotor frame, wherein the rotor frame comprises:

a first portion coupled to the shaft, the first portion extending in a radial direction from the shaft and corresponding to an inner shape of the hub, a second portion extending from the first portion in the direction parallel to the shaft, a stepped portion extending from a circumference of the second portion in the radial direction to correspond to the inner shape of the hub, the stepped portion being configured to restrict vibration transmitted to the shaft, a third portion extending from the stepped portion in the direction parallel to the shaft, and a coupling portion that is located on an inner circumferential surface of the third portion and that is configured to be coupled to the magnet, wherein the rotor frame has a protruding portion that protrudes toward the hub around the shaft, and wherein the hub has a recessed portion opposite to the protruding portion such that the hub does not directly contact the first portion.

13. The refrigerator of claim 12, wherein at least a portion of the rotor frame has a dome shape that accommodates the stator within the dome shape of the rotor frame.

14. The refrigerator of claim 12:

wherein the rotor frame includes a holding projection located between an inner circumferential surface of the second portion and an inner circumferential surface of the third portion, the holding projection being configured to fix a position of the magnet coupled to the coupling portion.

15. The refrigerator of claim 12, further comprising:

a first bearing disposed at a first side of the stator;

a second bearing disposed at a second side of the stator that is opposite to the first side of the stator, the first and second bearings being configured to fix a position of the stator;

a printed circuit board (PCB) assembly that is electrically connected to the stator and that is configured to apply electrical signals to the stator; and an insulator that is disposed between the rotor and the stator and that is configured to electrically insulate the rotor and the stator from each other.

16. The refrigerator of claim 12, wherein the hub has a dome shape having an inner diameter that increases toward the fan motor along the direction parallel to the shaft.

* * * * *